US007377303B2

(12) United States Patent
Go

(10) Patent No.: US 7,377,303 B2
(45) Date of Patent: May 27, 2008

(54) DIE CASTING MACHINE AND CASTING METHOD BY THEREOF MACHINE

(76) Inventor: Dong Keun Go, 103-705 Hamji Green Apt, 1124 Dongsamdong, Yeongdo-gu, Busan 606-751 (KR)

( * ) Notice: Subject to any disclaimer, the term of this patent is extended or adjusted under 35 U.S.C. 154(b) by 59 days.

(21) Appl. No.: 10/559,064

(22) PCT Filed: Jun. 3, 2004

(86) PCT No.: PCT/KR2004/001326

§ 371 (c)(1),
(2), (4) Date: Mar. 16, 2006

(87) PCT Pub. No.: WO2004/105979

PCT Pub. Date: Dec. 9, 2004

(65) Prior Publication Data

US 2007/0163743 A1 Jul. 19, 2007

(30) Foreign Application Priority Data

Jun. 3, 2003 (KR) ..... 20-2003-0017305 U
Jun. 4, 2003 (KR) ..... 10-2003-0035826
Jun. 25, 2003 (KR) ..... 20-2003-0020038 U

(51) Int. Cl.
*B22D 17/10* (2006.01)
*B22D 17/12* (2006.01)
*B22D 27/15* (2006.01)

(52) U.S. Cl. ..... 164/61; 164/65; 164/113; 164/133; 164/312; 164/258

(58) Field of Classification Search ..... 164/61, 164/65, 113, 133, 312, 255, 258
See application file for complete search history.

(56) References Cited

U.S. PATENT DOCUMENTS 4,055,216 A * 10/1977 Ulyanov et al. ..... 164/258
4,741,384 A * 5/1988 Healey ..... 164/514
5,205,338 A * 4/1993 Shimmell ..... 164/113
5,601,136 A 2/1997 Shimmell
5,860,468 A 1/1999 Cook
6,021,840 A 2/2000 Colvin

* cited by examiner

*Primary Examiner*—Kuang Lin
(74) *Attorney, Agent, or Firm*—Ladas & Parry LLP

(57) ABSTRACT

The present invention relates to a die casting machine. A molten metal (melted liquid) is supplied into a evacuated casting space that is formed by a combination of a movable mold and a fixed mold. The molten metal is first moved in a horizontal direction along a molten metal injection pipe and is then injected into a chamber located at the bottom of the casting space. Thereafter, the molten metal is moved in a vertical direction by means of a follower plunger and is then inserted into the casting space. Therefore, since occurrence of a turbulent flow of the molten metal injected into a mold is prevented, a product of a high quality with no minute bubbles can be obtained. Furthermore, the present invention relates to a die casting machine having a vacuum apparatus wherein a material is injected into a vacuum tank disposed in a melted liquid crucible via a pair of valves and another valve is also disposed even in a molten metal outflow hole of the vacuum tank to keep the degree of vacuum within the vacuum tank in a good state, whereby a good-quality product made of an alloy having a high melting point that is heavily oxidized in air can be produced, and casting method using the same.

4 Claims, 14 Drawing Sheets

DIE CASTING MACHINE AND CASTING METHOD BY THEREOF MACHINE

TECHNICAL FIELD

The present invention relates to a die casting machine and casting method using the same wherein a molten metal (melted liquid) is moved horizontally and is injected into a chamber and the molten metal is then moved vertically and is injected into a mold with a movable mold and a fixed mold disposed vertically, whereby the molten metal injected into the mold is prevented from generating a turbulent flow, so that a product of a good quality with no minute bubbles is obtained.

Furthermore, the present invention relates to a die casting machine having a vacuum apparatus wherein a material is injected into a vacuum tank disposed in a melted liquid crucible via a pair of valves and another valve is also disposed even in a molten metal outflow hole of the vacuum tank to keep the degree of vacuum within the vacuum tank in a good state, whereby a good-quality product made of an alloy having a high melting point that is heavily oxidized in air can be produced, and casting method using the same.

BACKGROUND ART

Forming using the casting machine includes injecting a molten metal into a mold and pressurizing the metal until it is solidified. This method has been widely used because of accuracy of a cast product, reduction in culling machining, etc.

As shown in FIGS. 7 and 8, a conventional die casting machine can be classified into a horizontal type die casting machine in which a molten metal (melted liquid) is moved horizontally and a vertical type die casting machine in which the molten metal is moved vertically. In the horizontal type die casting machine, when a molten metal is horizontally injected into the mold by a plunger, minute bubbles are generated due to severe occurrence of a turbulent flow in a L-shaped bend portion (T) of FIG. 7. Meanwhile, in the vertical type die casting machine, when a molten metal is horizontally injected into the mold by the plunger, minute bubbles are generated due to severe occurrence of a turbulent flow in a L-shaped bend portion (Q) of FIG. 8.

Therefore, minute bubbles are generated in a product. It is difficult to obtain a product of a good quality and to product a product of a high quality as a conventional die casting machine due to lots of defective products.

In addition, there was disclosed a conventional vacuum apparatus of a die casting machine for producing a product of a high quality in a vacuum state by shutting an alloy of a high melting point, which is easily oxidized by oxygen in air, from oxygen in air. Referring to FIG. 16, the conventional vacuum apparatus has a construction in which a fixed mold 100, a movable mold 200, a support rod 400 into which an induction coil coolant circulating pipe 110 and a power supply cable 900 are inserted, a melted liquid crucible 300 to which a high frequency induction coil 800 is fixed, and nippers 500 for injecting a material into the melted liquid crucible 300 are surrounded by one vacuum tank 600. In this construction, however, lots of time is taken to evacuate the interior of the vacuum tank 600 by means of the vacuum pump 700. Also, the degree of vacuum within the vacuum tank 600 is not good Therefore, there is a problem that a product of a good quality is not produced using an alloy of a high melting point that is easily oxidized in air.

DISCLOSURE OF INVENTION

Accordingly, the present invention has been made in view of the above problems, and it is an object of the present invention to provide a die casting machine wherein a molten metal is vertically injected into a mold with a fixed mold and a movable mold disposed in the vertical direction by very adequately combining a horizontal type in which the molten metal is horizontally injected and a vertical type in which the molten metal is vertically injected, whereby a turbulent flow of a moving molten metal is prevented form occurring to produce a product of a high quality with minute structure and no bubbles.

Another object of the present invention is to provide a vacuum apparatus of a die casting machine in which a valve and a small vacuum tank are disposed in a molten metal injection pipe portion of an existing die casting machine, a melted liquid crucible for rapidly making melted liquid a high vacuum state by means of the vacuum pump is disposed within the vacuum tank, and a pair of valves connected to a material injection pipe for injecting a material into the vacuum tank in a good vacuum state are disposed in a material injection unit of the vacuum tank, whereby the material is melted within the vacuum tank of a high vacuum state that is hardly affected by oxidization of oxygen in air, thus producing an alloy product of a high melting point with a good quality.

To achieve the above objects, according to the present invention, there is provided a die casting machine including a pair of supports that are disposed in the opposite direction on a machine body, a guide rod that connects the supports to guide a movable support plate, and the movable support plate movably fixed to the guide rod, wherein the plate is moved along the guide rod by means of a piston rod of a first cylinder fixed to one of the supports, a movable mold and a mold fixing plate for fastening the movable mold are disposed on one side of the movable support plate, a second cylinder is fixed on the other side of the movable support plate, a tablet having an ejector pin for pushing a shaped product from the movable mold fixed thereto is integrally fixed to a piston rod of the second cylinder, a molten metal injection pipe and a mold fixing plate are fixed on one side of the other one of the supports, a fixed mold having a molten metal guide hole formed therein is fixed to the mold fixing plate, a support rod is fixed on the other side of the other one of the supports, an additional support plate is disposed at the end of the support rod, a third cylinder is fixed to the support plate, whereby a plunger of the third cylinder pushes the molten metal into the molten metal injection pipe and the metal is cast within the casting space formed by the fixed mold and the movable mold according to the shape of the casting space, wherein the top of the machine body is formed with slant downwardly from the fixed mold toward the movable mold, one of the supports to which the fixed mold is fixed comprises a projection having the fixed mold fixed thereto, and a cylinder installation projection having a fourth cylinder fixed thereto, wherein the fixed mold is fixed to the projection and the fourth cylinder for driving a follower plunger is fixed to the cylinder installation projection, and a sleeve in which a chamber for containing molten metals and supplying the metals into the casting space formed on its top is formed is fixed to the mold fixing plates.

According to the present invention, there is provided a die casting machine including a pair of supports that are disposed in the opposite direction on a machine body, a guide rod that connects the supports to guide a movable support plate, and the movable support plate movably fixed to the guide rod, wherein the plate is moved along the guide rod by means of a piston rod of a first cylinder fixed to one of the supports, a movable mold and a mold fixing plate for fastening the movable mold are disposed on one side of the movable support plate, a second cylinder is fixed on the other side of the movable support plate, a tablet having an ejector pin for pushing a shaped product from the movable mold fixed thereto is integrally fixed to a piston rod of the second cylinder, a molten metal injection pipe and a mold fixing plate are fixed on one side of the other one of the supports, a fixed mold having a molten metal guide hole formed therein is fixed to the mold fixing plate, a support rod is fixed on the other side of the other one of the supports, an additional support plate is disposed at the end of the support rod, a third cylinder is fixed to the support plate, whereby a plunger of the third cylinder pushes the molten metal into the molten metal injection pipe and the metal is cast within the casting space formed by the fixed mold and the movable mold according to the shape of the casting space, the die casting machine, comprising: a vacuum tank in which a vacuum apparatus is connected to a vacuum pump; a material injection pipe for injecting a material into the vacuum tank; two or more valves disposed in the material injection pipe for precluding air from introducing into the vacuum tank while the material is injected; a fourth cylinder that makes a plunger follow it, for supplying the material into the vacuum tank via the material injection pipe; a melted liquid crucible disposed within the vacuum tank for melting the material; a rack and a pinion for making the melted liquid crucible inclined in order to supply a melting metal that is melted within the melted liquid crucible toward the molten metal injection pipe by rotating the melted liquid crucible; a molten metal outflow hole formed at the bottom of the vacuum tank for introducing the molten metal discharged from the melted liquid crucible into the molten metal injection pipe; and a first plate valve. disposed at a lower side of the vacuum tank for opening and shutting the molten metal outflow hole, wherein a plughole through which the plunger for pushing the material is formed in a second plate valve within one of the two or more valves that are fixed to the material injection pipe.

Furthermore, the vacuum apparatus is connected to the molten metal injection pipe of the die casting machine so that the molten metal melted in the melted liquid crucible within the vacuum tank is injected into the evacuated casting space formed by the combination of the fixed mold and the movable mold and is then cast.

According to the present invention, there is provided a method for injecting and casting a molten metal within a casting space formed by a combination of a fixed mold and a movable mold using a die casting machine, comprising: (1) a horizontal injection step of injecting the molten metal in a horizontal direction using a die casting machine according to claim 1 or 2 so that the molten metal is injected into a chamber of a sleeve along a molten metal injection pipe; and (2) a vertical injecting step of injecting the molten metal that is horizontally injected and contained in the chamber in a vertical direction using a follower plunger and is filled into a casting space.

A fixed mold and a movable mold are disposed vertically and a molten metal is moved horizontally. The molten metal is then moved to a plunger so that flows into a chamber. After a molten metal injection hole of the fixed mold is sealed by the plunger, the molten metal is moved vertically by a follower plunger and is inserted into a mold that is disposed vertically. The density and mechanical strength are high because minute bubbles are not generated due to occurrence of a turbulent flow. A product of a good quality whose surface is smooth can be obtained. Also, the yield of a product requiring high quality can be improved.

Furthermore, according to the present invention, a vacuum apparatus is connected to a molten metal injection pipe of a die casting machine. Even while a material is injected into the vacuum apparatus, the material is melted within the vacuum apparatus under vacuum while always keeping a good vacuum state. Thus, the material is cast within a evacuated casting space formed by a fixed mold and a movable mold through a molten metal injection pipe. Accordingly, an alloy product of a good quality and a high melting point can be manufactured.

BRIEF DESCRIPTION OF DRAWINGS

Further objects and advantages of the invention can be more fully understood from the following detailed description taken in conjunction with the accompanying drawings in which.

BEST MODE FOR CARRYING OUT THE INVENTION

Figure 1:
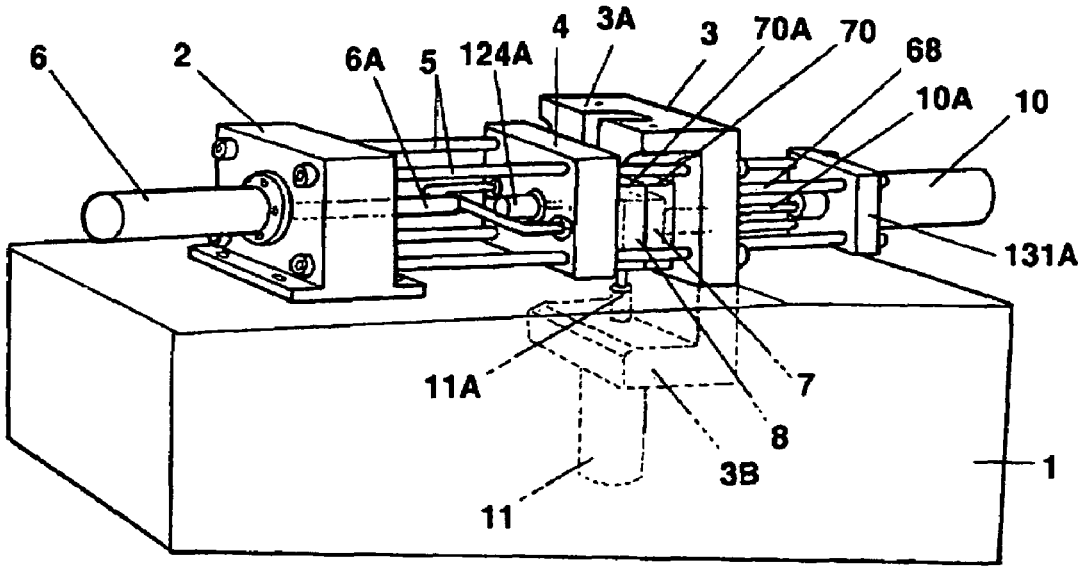
FIG. 1 is a perspective view illustrating the entire structure of a die casting machine according to the present invention.
Figure 2:
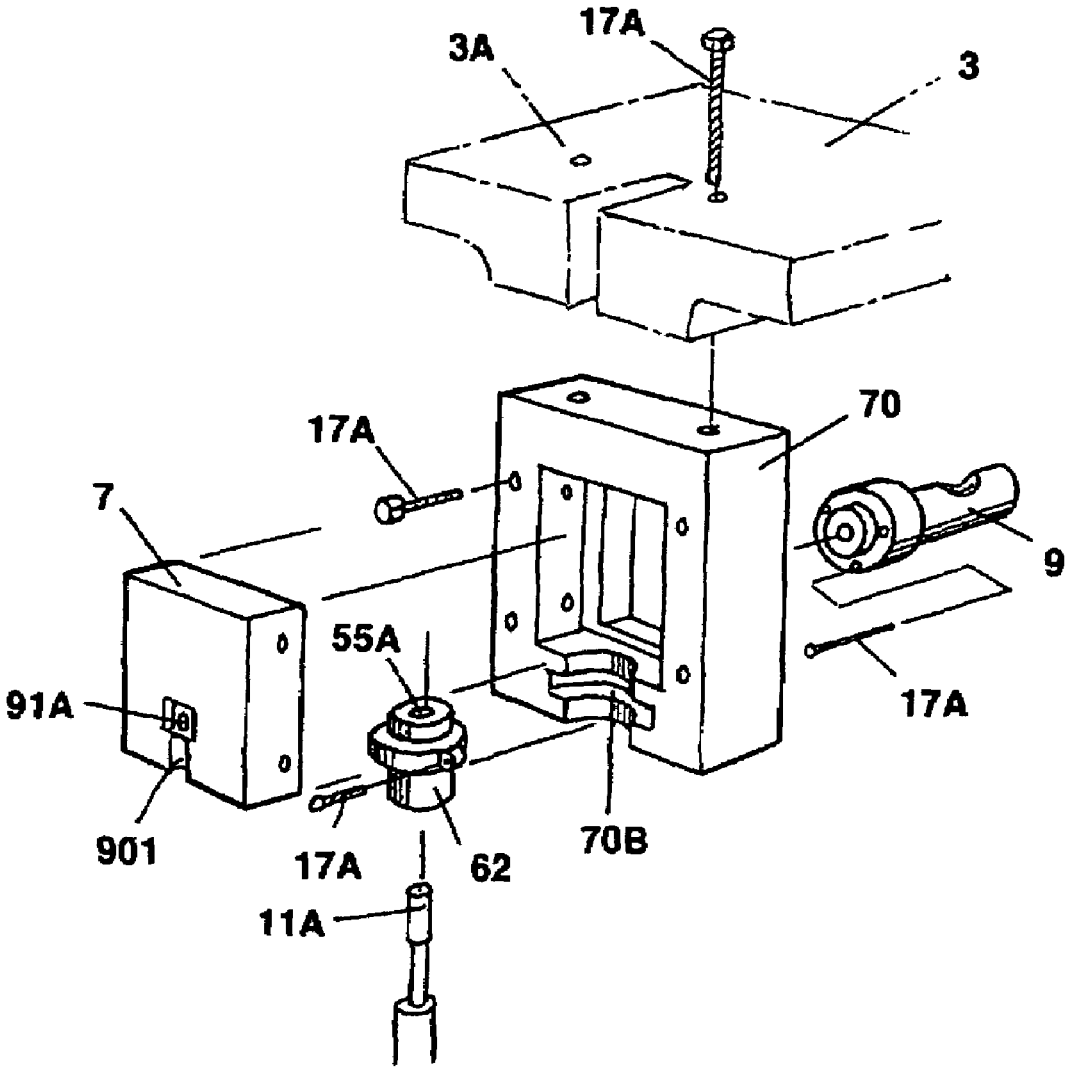
FIG. 2 is a perspective view illustrating main components of the die casting machine shown in FIG. 1 according to the present invention.

The present invention will now be described in detail in connection with preferred embodiments with reference to the accompanying drawings.

Referring to FIGS. 1 to 6, a die casting machine according to the present invention includes a pair of supports 2 and 3 that are disposed in the opposite direction on a machine body 1, a guide rod 5 that connects the supports 2 and 3 to guide a movable support plate 4, and the movable support plate 4 movably fixed to the guide rod 5, wherein the plate 4 is moved along the guide rod 5 by means of a piston rod 6A of a first cylinder 6 fixed to one of the supports 2 and 3.

A movable mold 8 and a mold fixing plate 70A for fastening the movable mold 8 are disposed on one side of the movable support plate 4 and a second cylinder 124A is fixed on the other side of the movable support plate 4. A tablet 65 to which an ejector pin 67 for pushing a shaped product 91A from the movable mold 8 is fixed is integrally fixed to a piston rod 120A of the second cylinder 124A. A molten metal injection pipe 9 and a mold fixing plate 70 are fixed on one side of the other one of the supports 2 and 3. A fixed mold 7 having a molten metal guide hole 91A formed therein is fixed to the mold fixing plate 70. A support rod 68 is fixed on the other side of the other one of the supports 2 and 3. Further, an additional support plate 131A is disposed at the end of the support rod 68. A third cylinder 10 is fixed to the support plate 131A, so that a plunger 10A of the third cylinder 10 pushes the molten metal into the molten metal injection pipe 9. Thus, the metal is cast within the casting space formed by the fixed mold 7 and the movable mold 8 according to the shape of the casting space.

In the above, the top of the machine body 1 is formed with slant downwardly from the fixed mold 7 toward the movable mold 8. The support 3 of the supports 2 and 3 to which the fixed mold 7 is fixed includes a projection 3A having the fixed mold 7 fixed thereto, and a cylinder installation projection 3B having a fourth cylinder 11 fixed thereto. The fixed mold 7 is fixed to the projection 3A. The fourth cylinder 11 for driving a follower plunger 11A is fixed to the cylinder installation projection 3B. A sleeve 62 in which a chamber 55A for containing molten metals 180A and supplying them into the casting space formed on its top is formed is fixed to the mold fixing plates 70 and 70A.

That is, according to the present invention, in order to form the product 191A that is thin and wide, it is preferred that the casting space formed by a combination of the fixed mold 7 and the movable mold 8 is formed in the vertical direction to the ground. Further, it is preferable that in injecting and shaping the molten metal into the casting space, the top of the machine body 1 is formed downwardly with slant from the fixed mold 7 to the movable mold 8. Through this construction, the molten metal 180A flows in the horizontal direction with slant and then enters the chamber 55A of the sleeve 62 that is located at the bottom of the casting space. In the above, he molten metal 180A is lifted up by the follower plunger 11A, moved in the vertical direction, introduced into the casting space and shaped therein.

Figure 7:
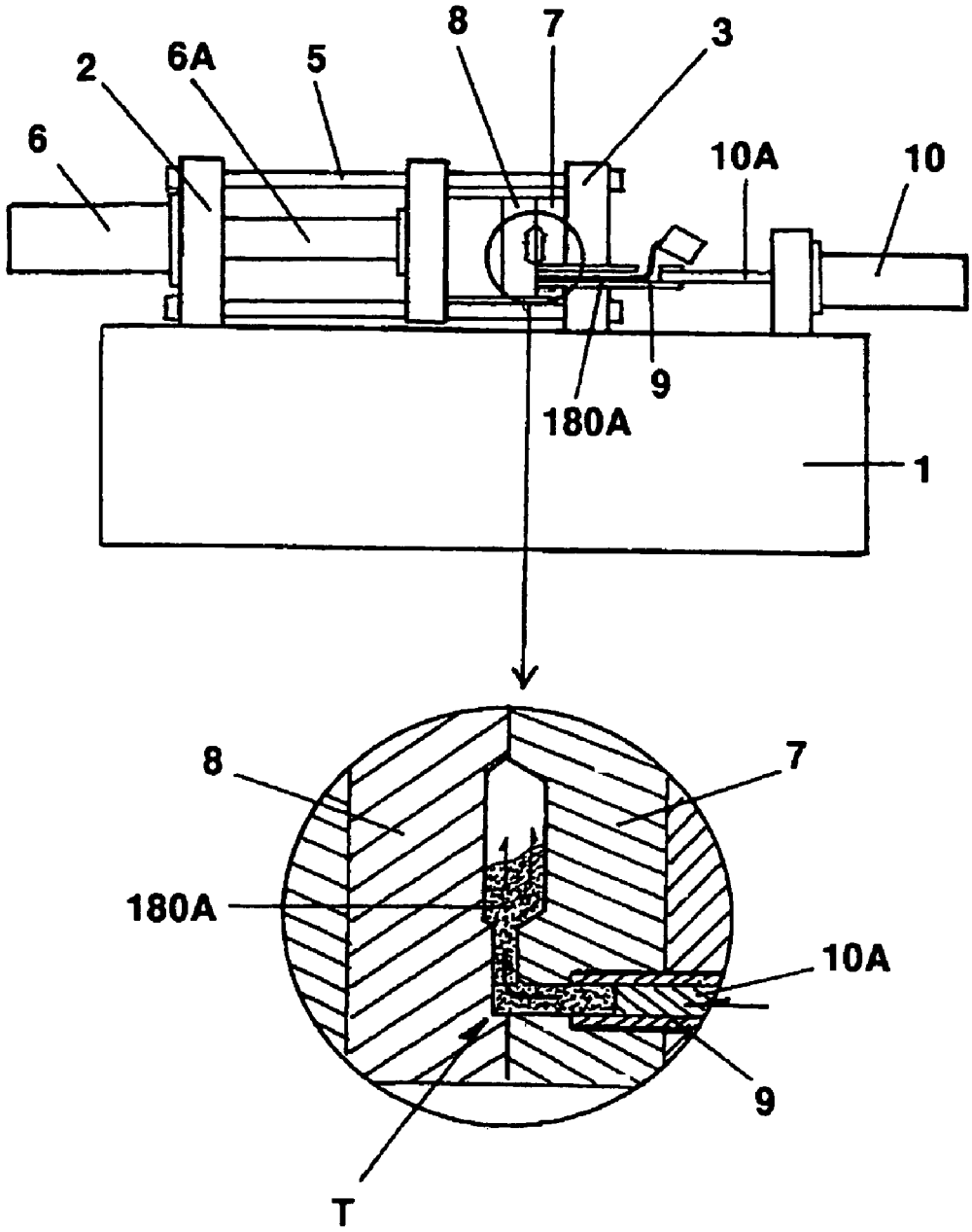
FIG. 7 schematically shows the construction of a conventional horizontal die casting machine.
Figure 8:
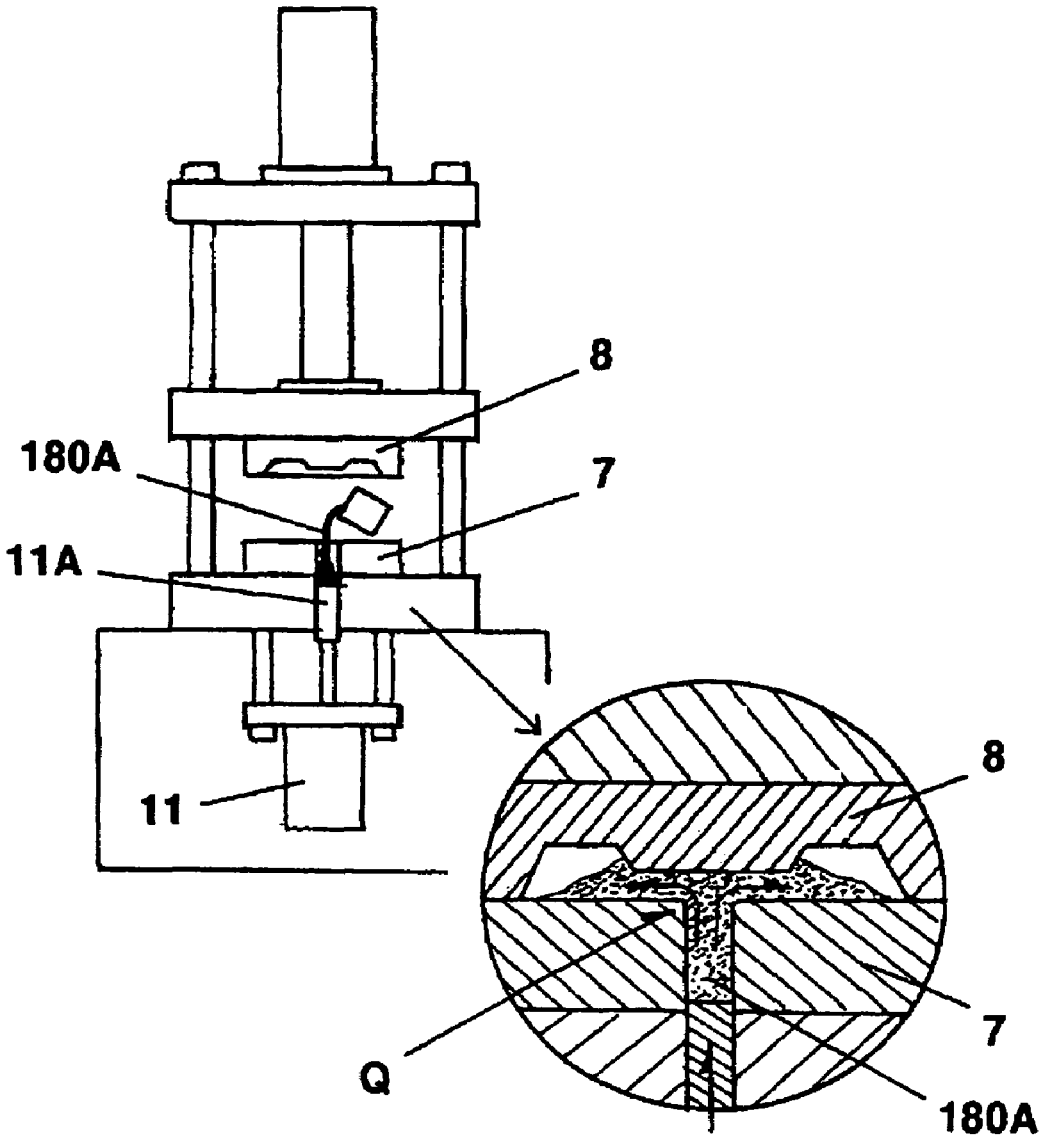
FIG. 8 schematically shows the construction of a conventional vertical die casting machine.
Figure 9:
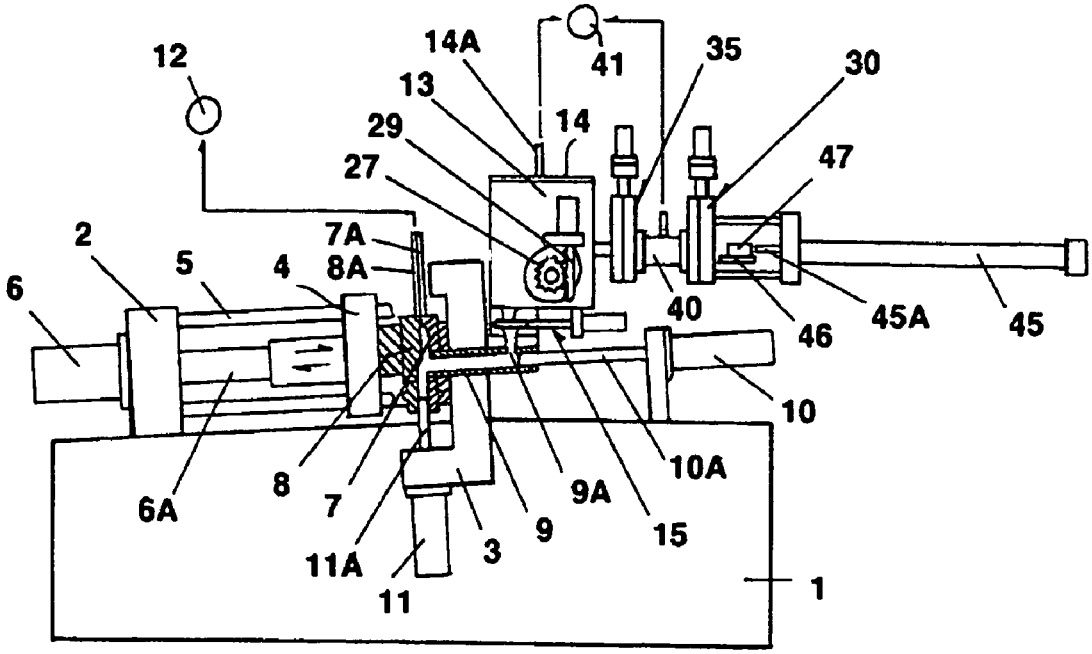
FIG. 9 shows the construction of the die casting machine to which a vacuum tank for making a material melt into the die casting machine of FIG. 1 a molten metal is connected.
Figure 10:
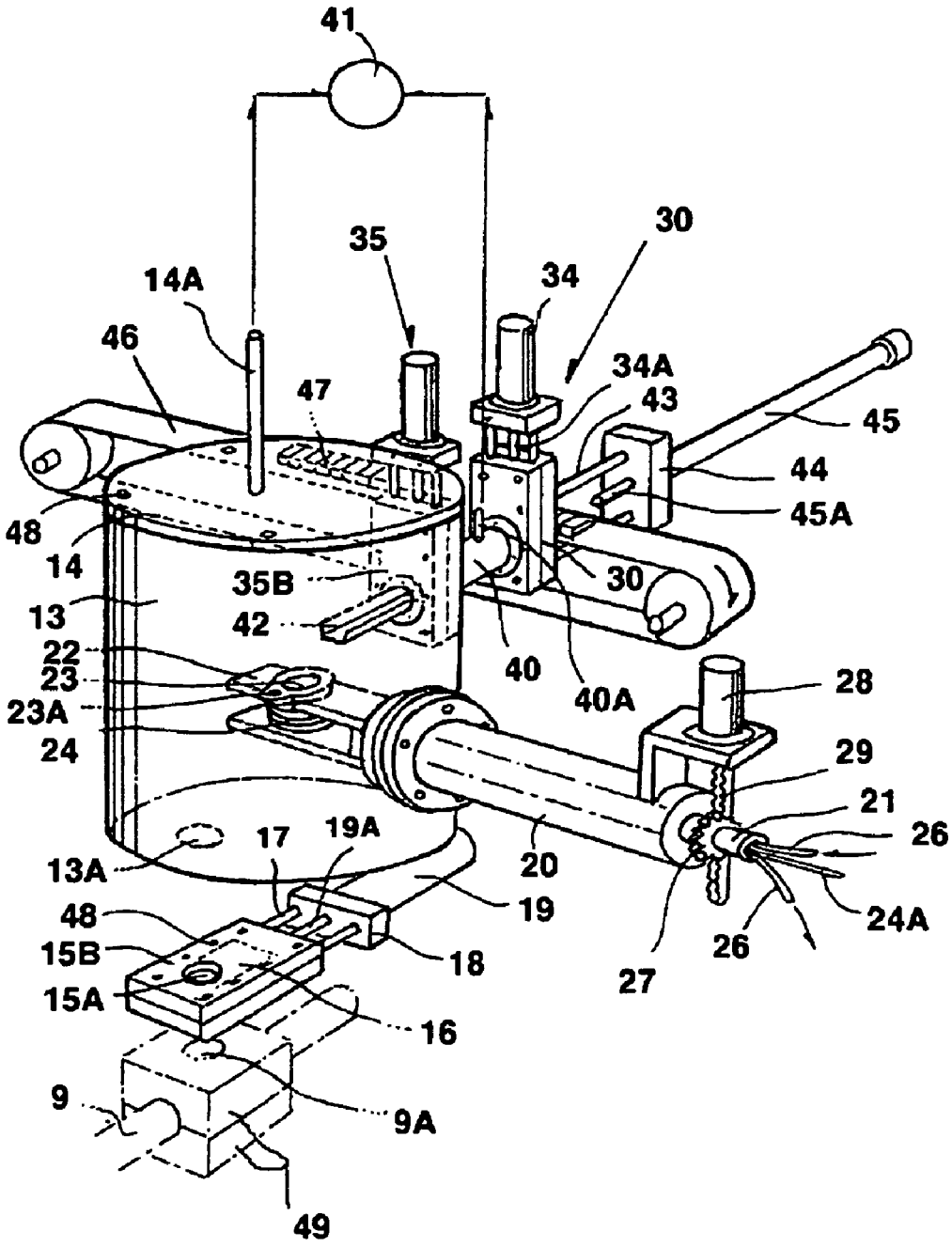
FIG. 10 is a perspective view illustrating the construction of the vacuum tank shown in FIG. 9.
Figure 11:
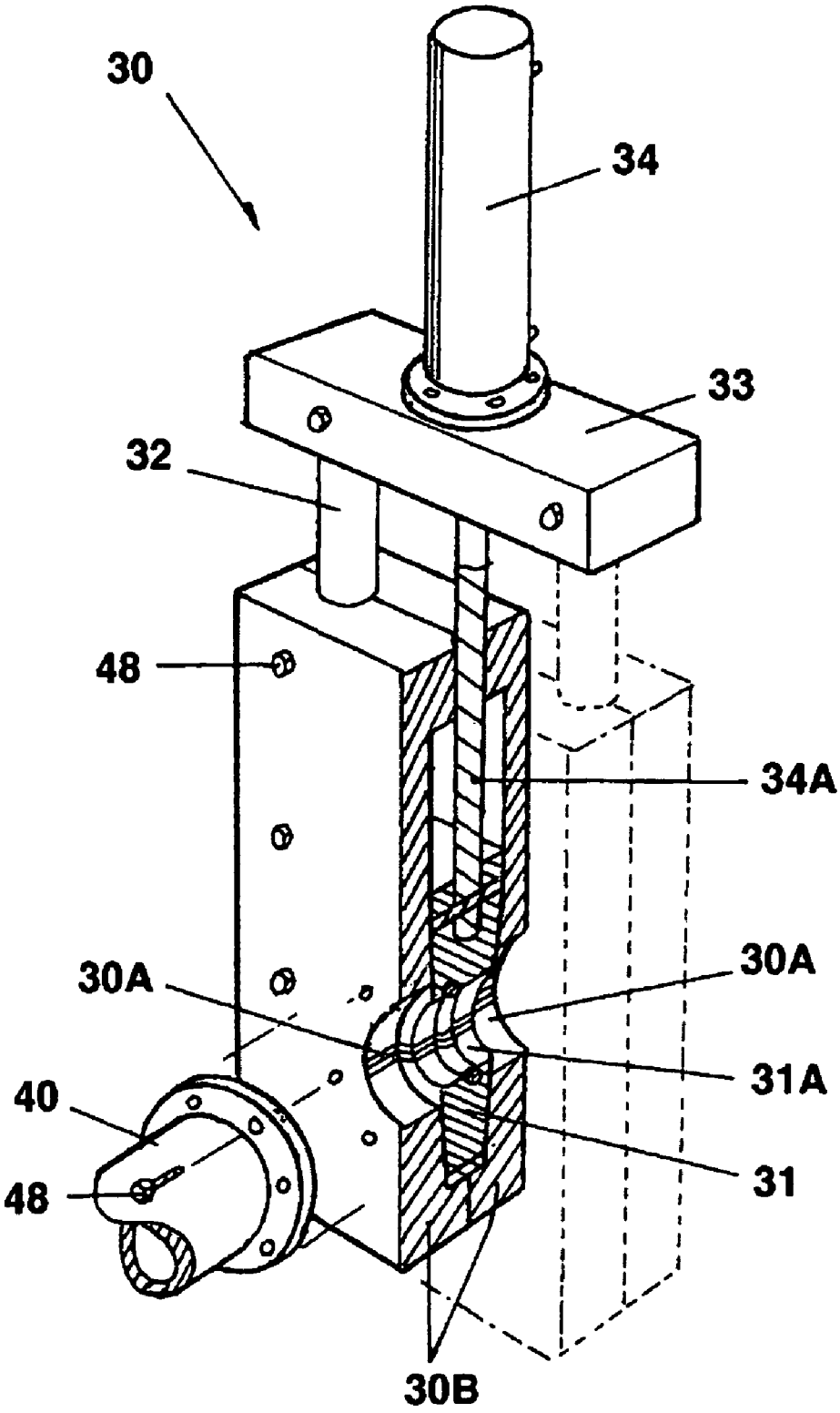
FIG. 11 is a partially cut view showing the valve shown in FIG. 9.

Accordingly, as shown in FIG. 7 and FIG. 8, a turbulent flow of a molten metal, which usually occurs in the conventional horizontal type die casting machine for horizontally injecting the molten metal 180A and the conventional vertical type die casting machine for vertically injecting the molten metal 180A, is prevented from occurring, it is thus possible to fabricate the product 191A of a high quality with fine structure and no bubbles.

In the above, it can be said that the die casting machine including the pair of the supports 2 and 3 that are disposed in the opposite direction on the machine body 1, the guide rod 5 that connects the supports 2 and 3 to guide the movable support plate 4, and the movable support plate 4 movably fixed to the guide rod 5, wherein the plate 4 is moved along the guide rod 5 by means of a piston rod 6A of a first cylinder 6 fixed to one of the supports 2 and 3, the movable mold 8 and the mold fixing plate 70A for fastening the movable mold 8 are disposed on one side of the movable support plate 4, the second cylinder 124A is fixed on the other side of the movable support plate 4, the tablet 65 to which the ejector pin 67 for pushing a shaped product 91A from the movable mold 8 is fixed is integrally fixed to the piston rod 120A of the second cylinder 124A, the molten metal injection pipe 9 and the mold fixing plate 70 are fixed on one side of the other one of the supports 2 and 3, the fixed mold 7 having the molten metal guide hole 91A formed therein is fixed to the mold fixing plate 70, the support rod 68 is fixed on the other side of the other one of the supports 2 and 3, the additional support plate 131A is disposed at the end of the support rod 68, and the third cylinder 10 is fixed to the support plate 131A so that a plunger 10A of the third cylinder 10 pushes the molten metal into the molten metal injection pipe 9, whereby the metal is cast within the casting space formed by the fixed mold 7 and the movable mold 8 according to the shape of the casting space, and the movable mold 8 is known to those skilled in the art before the present application was filed.

In the above construction, while the movable mold 8 is moved right and left against the fixed mold 7, the casting space is formed by a combination of the fixed mold 7 and the movable mold 8. The molten metal 180A is supplied into the casting space and is then shaped. The movable mold 8 is then separated from the fixed mold 7. Next, the shaped product 191A is separated from the movable mold 8 by means of the tablet 65 and the ejector pin 67 fixed thereto. Therefore, the movable mold 8 and the tablet 65 can be automatically operated.

In other words, in order to combine the movable mold 8 with the fixed mold 7, if the first cylinder 6 is operated to move the piston rod 6A forward, the movable support plate 4 fixed to the piston rod 6A is moved toward the support 3 having the fixed mold 7 fixed thereto. Thus, the fixed mold 7 and the movable mold 8 are combined to form the casting space that is made evacuated for shaping. Next, if the molten metal 180A is supplied through the molten metal injection pipe 9 fixed to the support 3, the molten metal 180A is introduced into the casting space and becomes the shaped product 191A while being cooled therein.

At this time, in supplying the molten metal 180A into the casting space, the third cylinder 10 fixed to the support plate 131A is operated and the molten metal is thus pushed into the molten metal injection pipe 9 by means of the plunger 10A followed by the third cylinder 10. Thereby, the molten metal is introduced into the casting space formed by the fixed mold 7 and the movable mold 8. Then, after some time elapse, the first cylinder 6 operates to move the piston rod 6A backward, the movable meld 8 is separated from the fixed mold 7.

Figure 6:
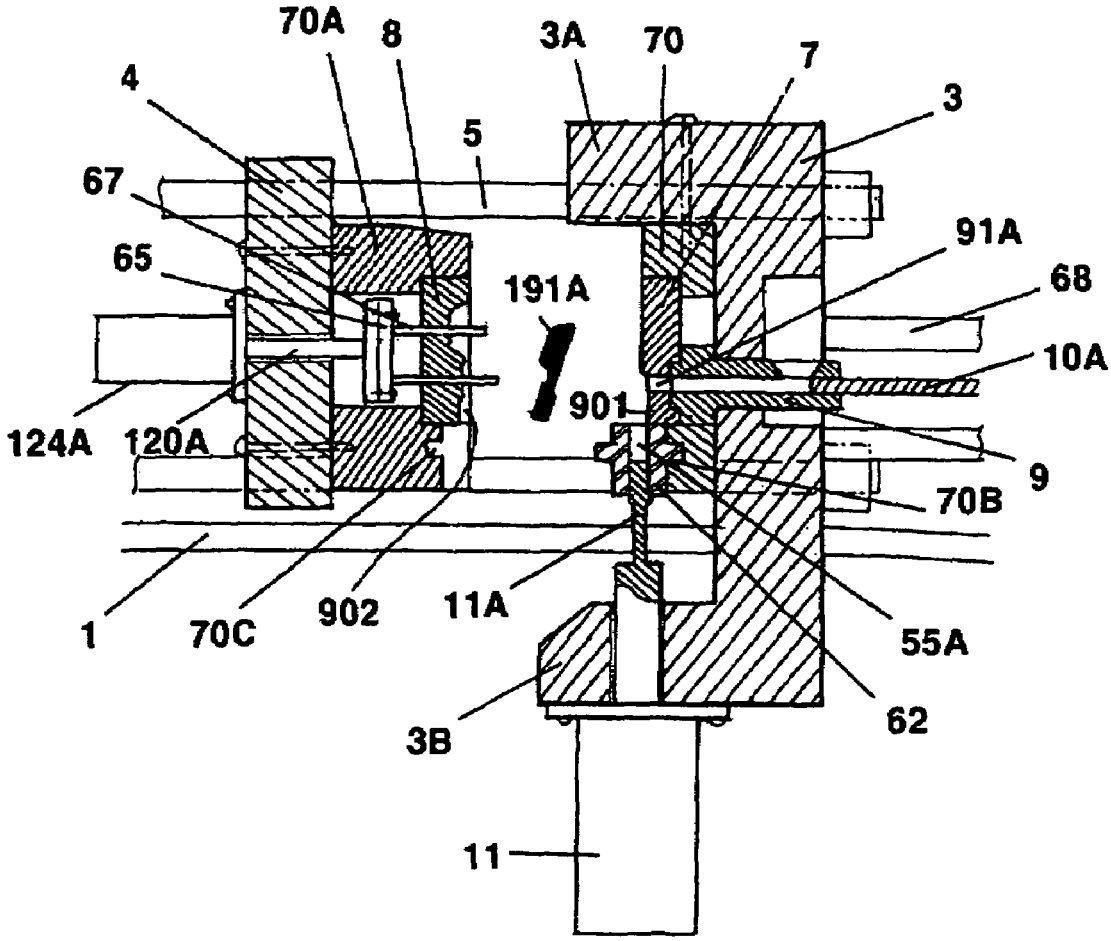

Thereafter, if the second cylinder 124A fixed to the movable support plate 4 is operated to move the piston rod 120A forward and thus move the tablet 65 forward, the product 191A attached to the movable mold 8 is separated by the ejector pin 67 integrally fixed to the tablet 65, as shown in FIG. 6. The cast product 191A is formed by repeatedly performing a series of the aforementioned operations.

In the present invention, more particularly, in order to facilitate the flow of the molten metal 180A, the top of the machine body 1 is formed downwardly with slant from the fixed mold 7 to the movable mold 8. The molten metal injection pipe 9 may be formed with slant and then fixed to the mold fixing plate 70 of the support 3. However, it would be disadvantages in close contact between the molten metal injection pipe 9 and the mold fixing plate 70. Accordingly, it is preferred that the whole top of the machine body 1 to which the supports 2 and 3 are fixed is formed with slant against the ground, as described above.

Moreover, the support 3 to which the fixed mold 7 is fixed among the supports 2 and 3 includes the projection 3A having the fixed mold 7 fixed thereto, and the cylinder installation projection 3B having the fourth cylinder 11 fixed thereto. The fixed mold 7 is fixed to the projection 3A, and the fourth cylinder 11 for driving the follower plunger 11A is fixed to the cylinder installation projection 3B. Therefore, the follower plunger 11A first pushes the molten metal 180A, which is supplied into the chamber 55A within the sleeve 62, into the casting space upwards in the horizontal direction. At this time, the fourth cylinder 11 for driving the follower plunger 11A can be fixed directly under the casting space that is formed by a combination of the fixed mold 7 and the movable mold 8. The sleeve 62 is inserted into semi-circular sleeve grooves 70B and 70C formed in the mold fixing plates 70 and 70A. In the above, in order to supply the molten metal 180A from the chamber 55A formed in the sleeve 62 to the casting space, semicircular vertical molten metal injection grooves 901 and 902 are formed in the fixed mold 7 and the movable mold 8 that form the casting space. The fourth cylinder 11 that makes a plunger 11A follow it is fixed to cylinder installation projection 3B at the bottom of the sleeve 62.

Figure 3:
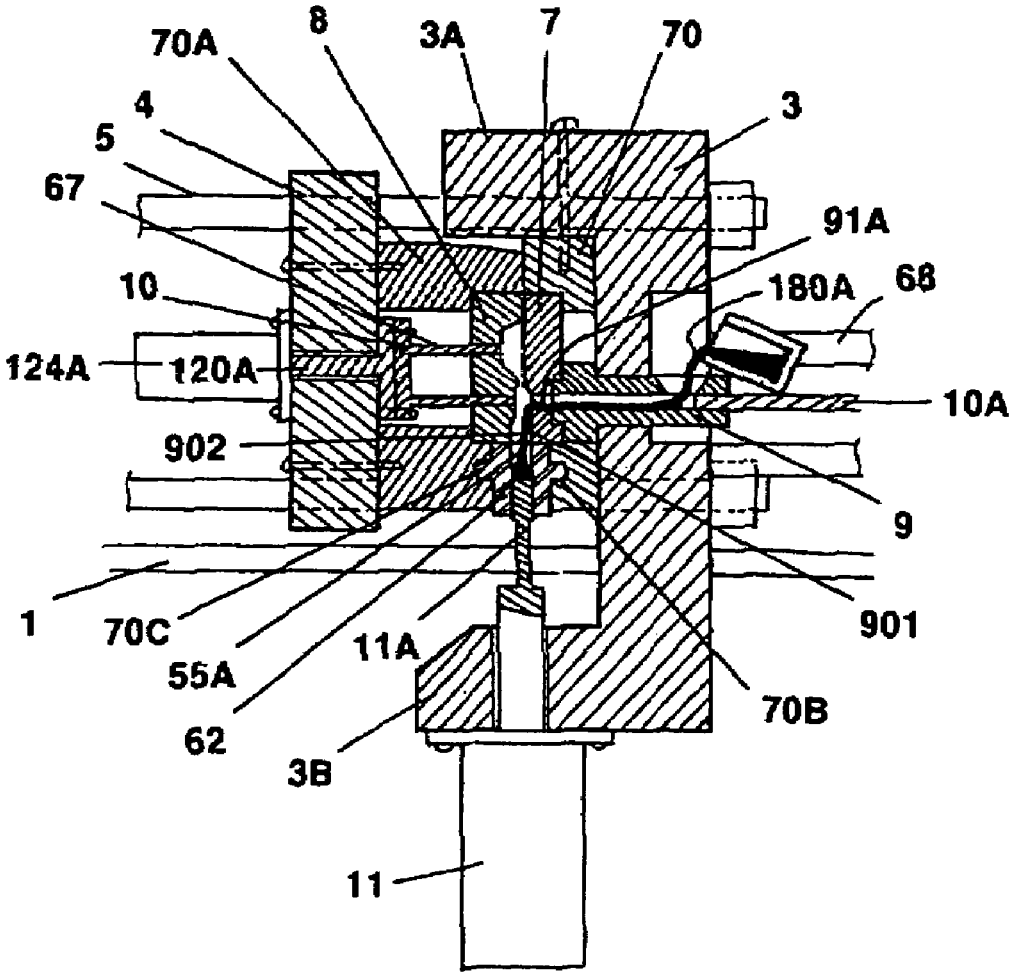
FIG. 3 is a cross-sectional view showing the operation of some components of the die casting machine according to an embodiment of the present invention.
Figure 4:
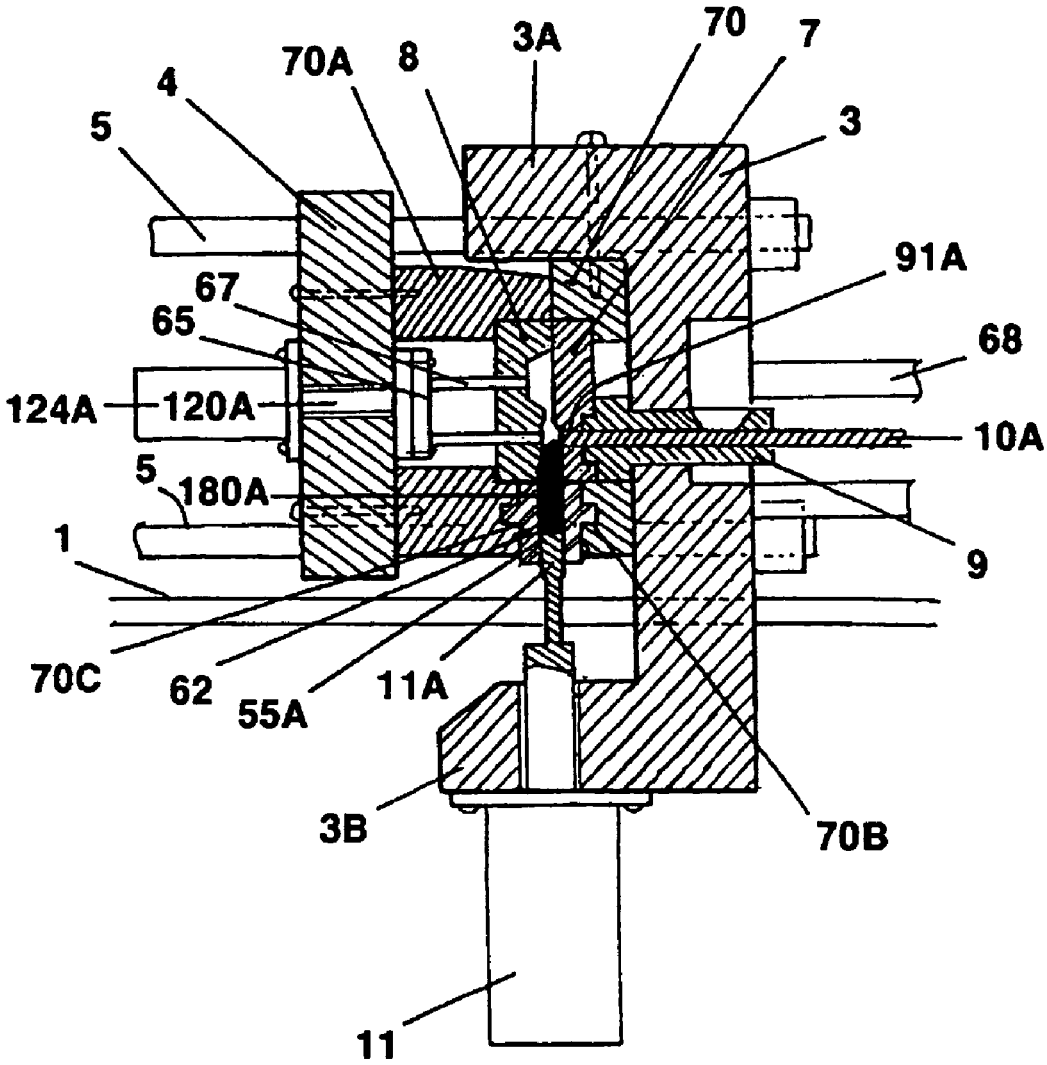
FIGS. 4 to 6 are cross-sectional views sequentially showing the operation of the die casting machine according to the present invention.
Figure 5:
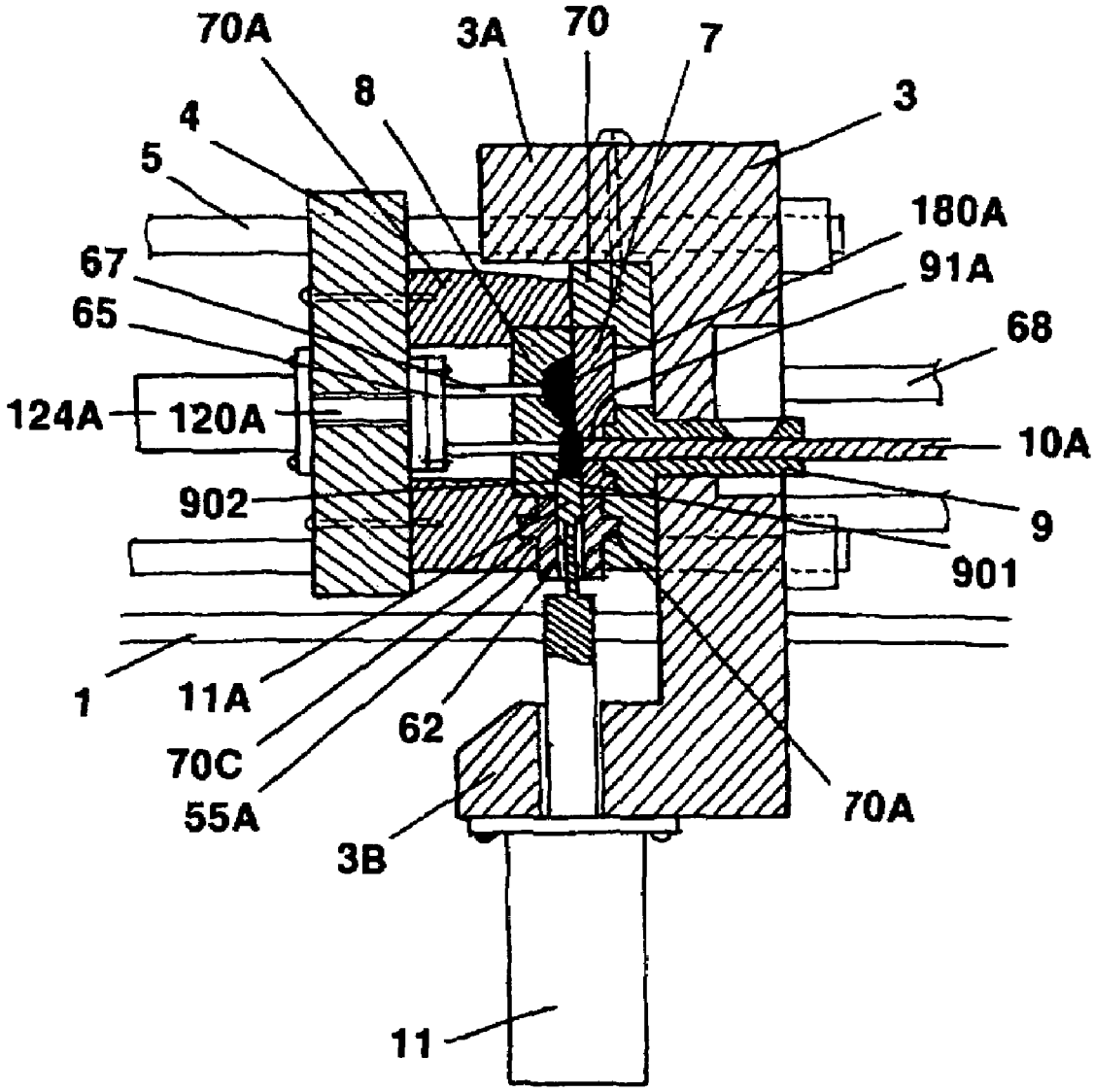

Therefore, as shown in FIG. 3 and FIG. 4, the molten metal 180A supplied into the molten metal injection pipe 9 is injected by means of the plunger 10A of the third cylinder 10 and is then filled within the chamber 55A of the sleeve 62 via the molten metal guide hole 91A and the semicircular vertical molten metal injection grooves 901 and 902, which are formed in the fixed mold 7. The plunger 10A keeps sealed the molten metal guide hole 91A of the fixed mold 7 and then raises the follower plunger 11A of the fourth cylinder 11. Thus, as shown in FIG. 5, the molten metal 180A within the semicircular vertical molten metal injection grooves 901 and 902 and the chamber 55A is injected into the casting space that is formed by a combination of the fixed mold 7 and the movable mold 8.

At this time, the molten metal 180A is first moved in the horizontal direction against the ground, preferably in the horizontal direction along the molten metal injection pipe 9 that is downwardly slanted toward the sleeve 62. The molten metal 180A is then introduced into the semicircular vertical molten metal injection grooves 901 and 902 located right under the casting space and the chamber 55A without forming a turbulent flow. Continuously, the molten metal 180A is injected into the casting space in the vertical direction by means of the operation of the follower plunger 11A, as shown in FIG. 5. At this time, the fixed mold 7 and the movable mold 8 are vertically disposed. Thus, the molten metal 180A can be introduced into the casting space smoothly without generating a turbulent flow. Accordingly, bubbles can be prevented from occurring and the product 191A with fine structure and no bubbles can be produced continually.

The mold fixing plates 70 and 70A, the molten metal injection pipe 9, the sleeve 62 and the like are fastened with bolts 17A. It is to be noted that the present invention is not limited to the above but may be modified without the gist of the present invention.

Furthermore, referring to FIGS. 9 to 12, a die casting machine according to the present invention includes a pair of supports 2 and 3 that are disposed in the opposite direction on a machine body 1, a guide rod 5 that connects the supports 2 and 3 to guide a movable support plate 4, and the movable support plate 4 movably fixed to the guide rod 5, wherein the plate 4 is moved along the guide rod 5 by means of a piston rod 6A of a first cylinder 6 fixed to one of the supports 2 and 3.

A movable mold 8 and a mold fixing plate 70A for fastening the movable mold 8 are disposed on one side of the movable support plate 4 and a second cylinder 124A is fixed on the other side of the movable support plate 4. A tablet 65 to which an ejector pin 67 for pushing a shaped product 91A from the movable mold 8 is fixed is integrally fixed to a piston rod 120A of the second cylinder 124A. A molten metal injection pipe 9 and a mold fixing plate 70 are fixed on one side of the other one of the supports 2 and 3. A fixed mold 7 having a molten metal guide hole 91A formed therein is fixed to the mold fixing plate 70. A support rod 68 is fixed on the other side of the other one of the supports 2 and 3. Further, an additional support plate 131A is disposed at the end of the support rod 68. A third cylinder 10 is fixed to the support plate 131A, so that a plunger 10A of the third cylinder 10 pushes the molten metal into the molten metal injection pipe 9. Thus, the metal cast within the casting space formed by the fixed mold 7 and the movable mold 8 according to the shape of the casting space.

The die casting machine further includes a vacuum tank 13 in which a vacuum apparatus is connected to a vacuum pump 41; a material injection pipe 40 for injecting a material 47 into the vacuum tank 13; two or more valves 30 and 35 disposed in the material injection pipe 40 for precluding air from introducing into the vacuum tank 13 while the material 47 is injected; a fifth cylinder 45 that makes a plunger 45A follow it, for supplying the material 47 into the vacuum tank 13 via the material injection pipe 40; a melted liquid crucible 23 disposed within the vacuum tank 13 for melting the material 47; a rack 29 and a pinion 27 for making the melted liquid crucible 23 inclined in order to supply a melting metal 180A that is melted within the melted liquid crucible 23 toward the molten metal injection pipe 9 by rotating the melted liquid crucible 23; a molten metal outflow hole 13A formed at the bottom of the vacuum tank 13 for introducing the molten metal 180A discharged from the melted liquid crucible 23 into the molten metal injection pipe 9; and a plate valve 16 disposed at a lower side of the vacuum tank 13 for opening and shutting the molten metal outflow hole 13A. In the above, a plughole 31A through which the plunger 45A for pushing the material 47 is formed in a plate valve 31 within the valve 30 of the two or more valves 30 and 35 fixed to the material injection pipe 40.

In other words, in the casting method using an alloy of a high melting point, in order to preclude the alloy that is easily oxidized by oxygen in air from oxygen in air and thus to produce a product of a high quality in a vacuum state, the vacuum apparatus is connected to the molten metal injection pipe 9 of the die casting machine. While keeping a good vacuum state even when the material 47 is injected into the vacuum apparatus, the material is melted under a vacuum condition within the vacuum apparatus and is then cast within the evacuated casting space formed by the fixed mold 7 and the movable mold 8 via the molten metal injection pipe 9. Accordingly, an alloy product of a high melting point and a high quality can be produced.

In the die casting machine having the vacuum apparatus according to the present invention, the plate valve 16 is movably inserted into the pair of valve body 15B that are fastened with the bolts 48 at an entrance 9A portion of the molten metal injection pipe 9. The plate valve 16 is at one with the molten metal outflow hole 15A of the valve 15, which is opened and shut by a piston rod 19A of the cylinder 19 fixed to the support plate 18 that is supported by the support rod 17.

Meanwhile, the molten metal outflow hole 13A of the vacuum tank 13 is disposed in accord with the molten metal outflow hole 15A. The vacuum tank is sealed by a cover 14 having an air exhaust pipe 14A formed therein. A housing 20 in which a hollow shaft 21 is rotatably disposed is fixed to one side of the vacuum tank 13. A furnace support 22 is fixed to the end of the hollow shaft 21 located within the vacuum tank 13 and a melted liquid crucible 23 of a kettle shape in which a hole 23A is formed is disposed. A high frequency induction coil 24 is wound on the melted liquid crucible 23. An induction coil coolant circulating pipe 26 and a power supply cable 24A are inserted into the hollow shaft 21. The pinion 27 fixed to the hollow shaft 21 is geared with the rack 29 formed in the piston rod of the cylinder 28 to rotate the hollow shaft 21.

Furthermore, the plate valve 31 having the plughole 31A formed therein is movably inserted into the pair of the valve body 30B having the material injection hole 30A formed therein on the other side of the vacuum tank 13. Thereby, a valve 30 whose plate valve 31 is opened and shut by means of an up-and-down motion of a piston rod 34A of a sixth cylinder 34 that is fixed to a support plate 33 supported by a support rod 32, and a plate valve 36 are movably inserted into the pair of the valve body 35B in which a material injection hole 35A is formed. A valve 35 whose plate valve 36 is opened and shut by a piston rod 39A of a seventh cylinder 39 fixed to a support plate 38 supported by a support rod 37, and a material injection pipe 40 having an air exhaust pipe 40A formed therein are connected. The air exhaust pipe 40A is connected to the vacuum pump 41. A material guide plate 42 fixed to the valve 35 are disposed within the vacuum tank 13. The fifth cylinder 45 is fixed to a support plate 44 of a support rod 43 fixed to the valve 30, so that the material 47 moved by the conveyor 46 is injected into the vacuum tank 13 by means of the plunger 45A of the fifth cylinder 45.

Figure 12:
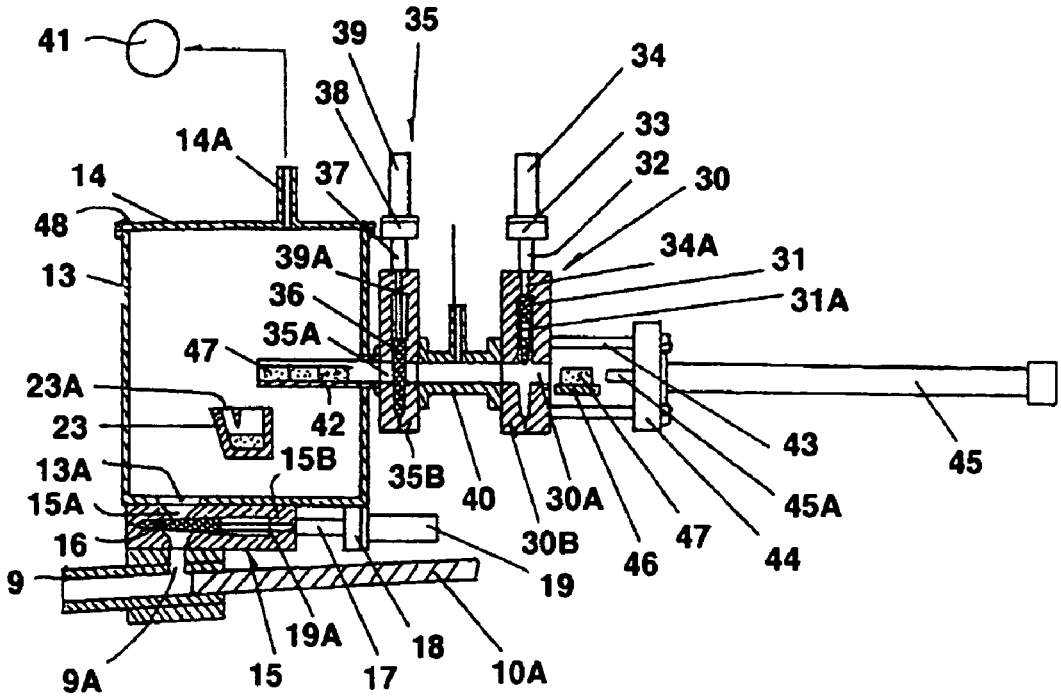
FIG. 12 is a cross-sectional view of the vacuum tank shown in FIG. 10.
Figure 13:
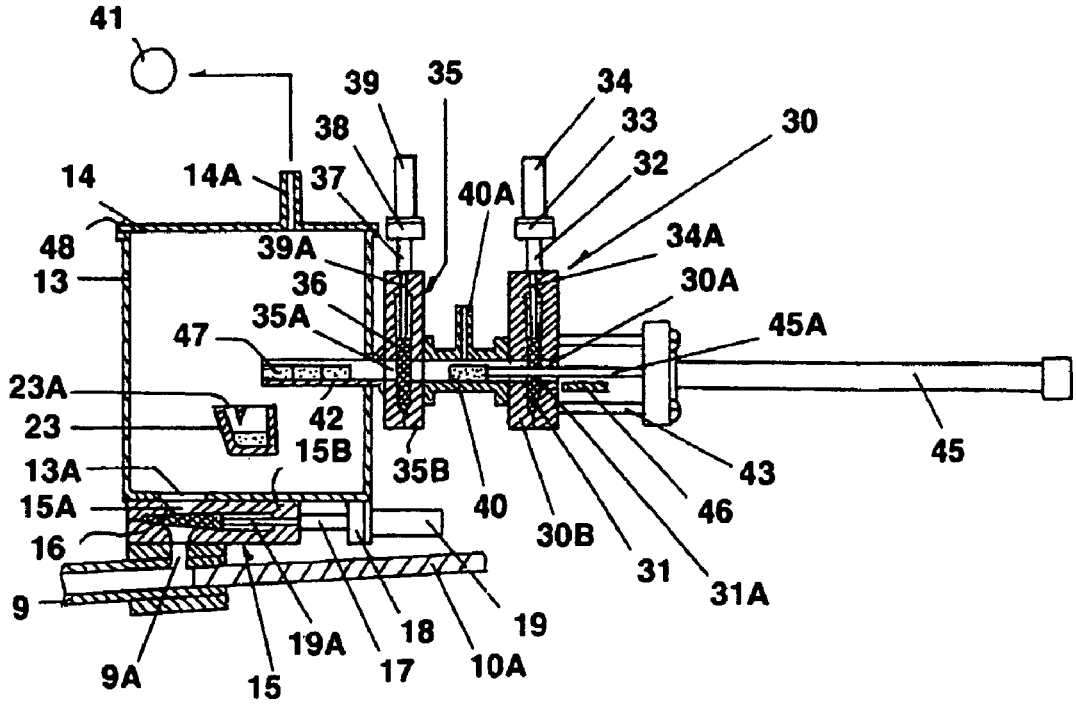
FIGS. 13 to 15 are cross-sectional views sequentially showing the operation of a die casting machine according to another embodiment of the present invention.
Figure 14:
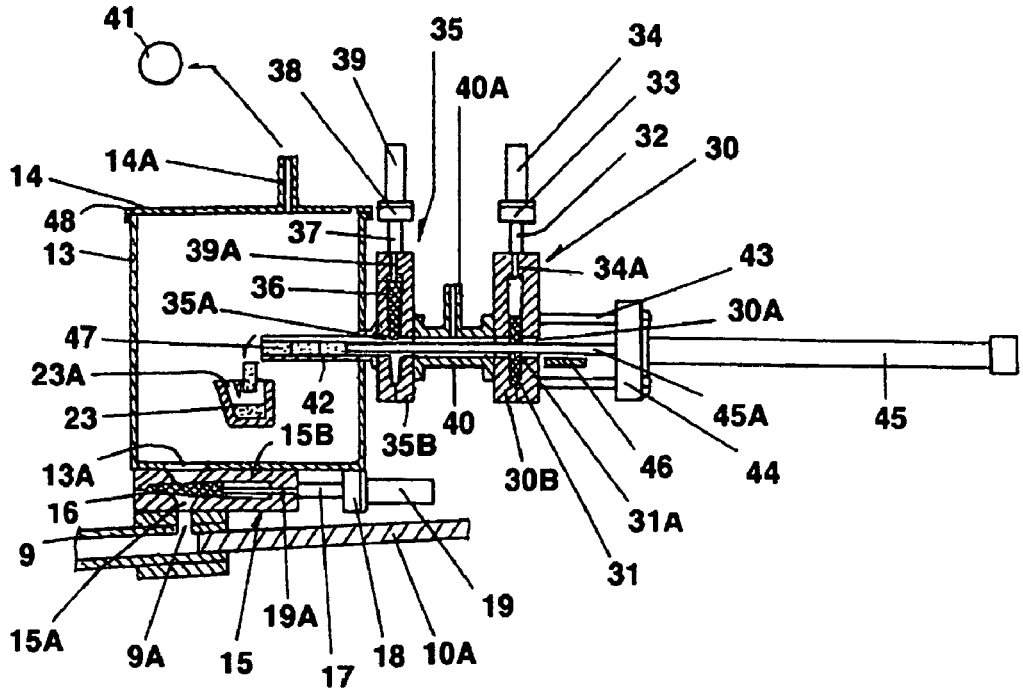

Therefore, as shown in FIG. 12, if the material is transferred in front of the valve 30 through a conveyor 46, the sixth cylinder 34 is driven to make the piston rod 34A follow it, thus lifting up the plate valve 31 of the valve 30 to open the valve 30. Thereafter, the fifth cylinder 45 is driven to make the plunger 45A follow it, so that the material 47 is inserted into the material injection pipe 40 by means of the plunger 45A. Next, as shown in FIG. 13 and FIG. 14, the plunger 45A is first moved backward. The plate valve 31 of the valve 30 is then lowered down to shut the valve 30. Then, the plunger 45A is moved forward again through the plughole 31A that is formed in the plate valve 31 of the valve 30. Thus, the plughole 31A formed in the plate valve 31 within the valve 30 is clogged with the plunger 45A.

Figure 15:
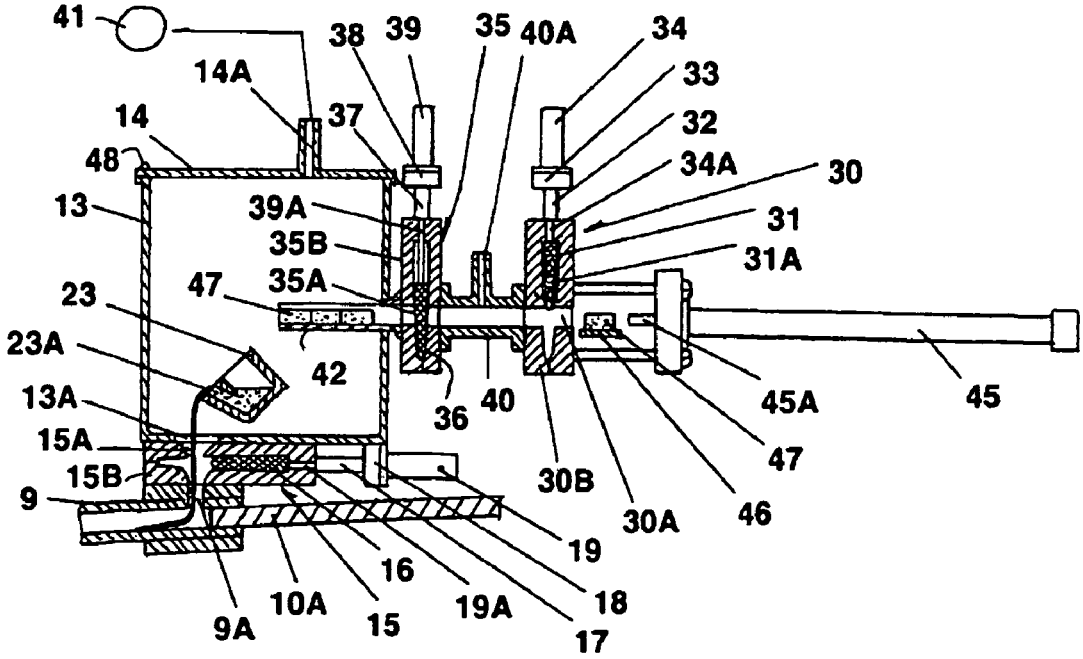
Figure 16:
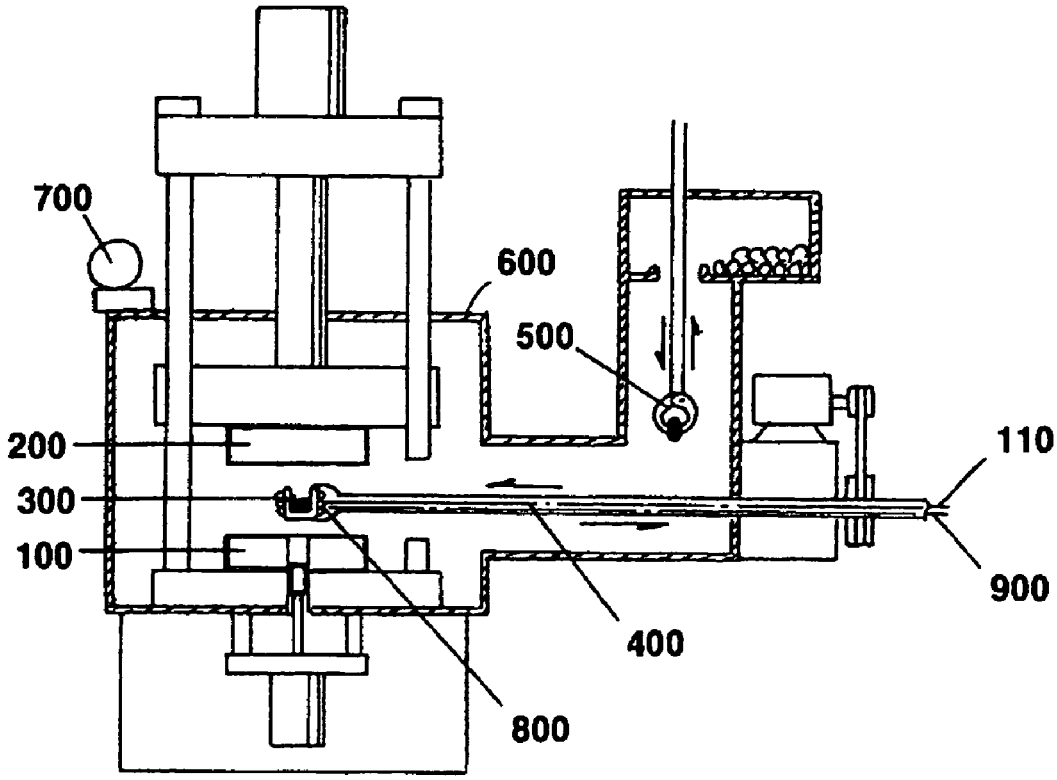
FIG. 16 schematically shows the construction of a die casting machine including a conventional vacuum tank.

In this state, similarly, the cylinder 39 is driven to make the piston rod 39A follow it, thus lifting up the plate valve 36 to open the valve 35. The plunger 45A is moved forward so that the material 47 reaches the material guide plate 42. Through a subsequent operation, the materials 47 are injected into the melted liquid crucible 23 one by one and are then melt. Thereafter, the plunger 45A is moved backward so that the end of the plunger 45A is located at the middle of the material injection pipe 40, preferably between the valve 35 and the valve 30. After the valve 35 is shut, the plunger 45A is moved backward so that the plunger 45A exits the plughole 31A formed in the plate valve 31 of the valve 30. As shown in FIG. 15, after the plunger 45A is continuously moved backward, the plate valve 31 of the valve 30 is lifted up in opposition so that the material 47 is injected again. Accordingly, before and after the material 47 is injected as well as while the material 47 is injected, the vacuum tank 13 is not fully opened in a standby state. It is thus possible to keep the interior of the vacuum tank 13 at a high vacuum state.

According to the present invention constructed above, the movable support plate 4 fixed to the piston rod 6A of the first cylinder 6 is moved toward the support 3 to adhere the movable mold 8 to the fixed mold 7. Air is exhausted by means of air exhaust pipes 7A and 8A and a vacuum pump 12. Thus, The vacuum state of the casting space formed by a combination of the fixed mold 7 and the movable mold 8 keeps lower than the atmospheric pressure. The molten metal 180A that is drained from the vacuum tank 13 by means of the plunger 10A of the third cylinder 10 is transferred along the molten metal injection pipe 9 in the horizontal direction. Next, the molten metal 180A is vertically transferred to the evacuated casting space that is formed by a combination of the fixed mold 7 and the movable mold 8 by means of the follower plunger 11A of the fourth cylinder 11 and is then cast within the casting space.

The plate valves 31 and 36 of the valves 30 and 35 that are fixed to the material injection pipe 40 pass through the material 47 while they are opened and shut alternately. However, the vacuum tank 13 connected to the material injection pipe 40 makes at least one of the two valves 30 and 35 shut. Thus, since the valve is completely prevented from being exposed to air, the interior of the vacuum tank 13 is always kept at a high vacuum state. In a state where the two valves 30 and 35 are shut, air within the material injection pipe 40 is exhausted via the air exhaust pipe 40A formed in the material injection pipe 40 by means of the vacuum pump 41, keeping the interior of the vacuum tank 13 evacuated. Accordingly, after air that was introduced along with the introduction of the material 47 is removed, a high vacuum state is kept although the valve 35 connected to the vacuum tank 13 is opened. Thereafter, the plate valve 36 of the valve 35 is raised to open the material injection hole 35A. The material 47 within the material injection pipe 40 is pushed toward the plunger 45A, injected into the melted liquid crucible 23 of a kettle shape within the vacuum tank 13 and then melted.

At this time, three materials 47 are disposed on the material guide plate 42 and are then preheated. By supplying next materials 47, the materials are sequentially injected into melted liquid crucible 23 one by one. Also, the melted liquid crucible 23 is formed in a size that can melt several materials 47. If the molten metal 180A of the melted liquid crucible 23 is to be introduced into the entrance 9A of an existing molten metal injection pipe 9 by means of the high frequency induction coil 24, the plate valve 16 of the valve 15 is moved to open the molten metal outflow hole 15A. The pinion 27 and the hollow shaft 21 are rotated by the rack 29 of the cylinder 28 to make the melted liquid crucible 23 inclined. Therefore, as shown in FIG. 15, the molten metal 180A can be injected into the molten metal injection pipe 9 through the molten metal outflow hole 13A of the vacuum tank 13, the molten metal outflow hole 15A of the valve 15, and the entrance 9A.

In the above, the amount of fusion of the material 47 of the melted liquid crucible 23 can be several times as high as the internal volume of the mold. This corresponds to the amount the material 47 that can form about 1 to 10 products. The melted liquid crucible 23 is formed in a kettle shape. Thus, when the molten metal is dumped, it is drained through the hole 23A, as shown in FIG. 15. Impurities such as slag floated on the melted liquid crucible 23 are prevented from being exhausted through the hole 23A.

The aforementioned operation has been described based on one time product manufacturing process. Products can be mass-produced by repeating the operation.

INDUSTRIAL APPLICABILITY

According to the present invention, a fixed mold and a movable mold are disposed vertically and a molten metal is moved horizontally. The molten metal is then moved to a plunger so that flows into a chamber. After a molten metal injection hole of the fixed mold is sealed by the plunger, the molten metal is moved vertically by a follower plunger and is inserted into a mold that is disposed vertically. Therefore, the present invention has effects that the density and mechanical strength are high since minute bubbles are not generated due to occurrence of a turbulent flow, a product of a good quality whose surface is smooth is obtained and the yield of a product requiring high quality is improved.

Furthermore, according to the present invention, a vacuum apparatus is connected to a molten metal injection pipe of a die casting machine. Even while a material is injected into the vacuum apparatus, the material is melted within the vacuum apparatus under vacuum while always keeping a good vacuum state. Thus, the material is cast within a evacuated casting space formed by a fixed mold and a movable mold through a molten metal injection pipe. Accordingly, the present invention has an effect that it can fabricate an alloy product of a good quality and a high melting point.

What is claimed is:

1. A die casting machine including a pair of supports that are disposed in the opposite direction on a machine body, a guide rod that connects the supports to guide a movable support plate, and the movable support plate movably fixed to the guide rod, wherein the plate is moved along the guide rod by means of a piston rod of a first cylinder fixed to one of the supports, a movable mold and a mold fixing plate for fastening the movable mold are disposed on one side of the movable support plate, a second cylinder is fixed on the other side of the movable support plate, a tablet having an ejector pin for pushing a shaped product from the movable mold fixed thereto is integrally fixed to a piston rod of the second cylinder, a molten metal injection pipe and a mold fixing plate are fixed on one side of the other one of the supports, a fixed mold having a molten metal guide hole formed therein is fixed to the mold fixing plate, a support rod is fixed on the other side of the other one of the supports, an additional support plate is disposed at the end of the support rod, a third cylinder is fixed to the support plate, whereby a plunger of the third cylinder pushes the molten metal into the molten metal injection pipe and the metal is cast within the casting space formed by the fixed mold and the movable mold according to the shape of the casting space, wherein the top of the machine body is formed with slant downwardly from the fixed mold toward the movable mold, one of the supports to which the fixed mold is fixed comprises a projection having the fixed mold fixed thereto, and a cylinder installation projection having a fourth cylinder fixed thereto, wherein the fixed mold is fixed to the projection and the fourth cylinder for driving a follower plunger is fixed to the cylinder installation projection, and a chamber formed within a sleeve that is located at the bottom of the casting space, wherein the chamber supplies the molten metal to the casting space by the follower plunger.

2. A die casting machine including a pair of supports that are disposed in the opposite direction on a machine body, a guide rod that connects the supports to guide a movable support plate, and the movable support plate movably fixed to the guide rod, wherein the plate is moved along the guide rod by means of a piston rod of a first cylinder fixed to one of the supports, a movable mold and a mold fixing plate for fastening the movable mold are disposed on one side of the movable support plate, a second cylinder is fixed on the other side of the movable support plate, a tablet having an ejector pin for pushing a shaped product from the movable mold fixed thereto is integrally fixed to a piston rod of the second cylinder, a molten metal injection pipe and a mold fixing plate are fixed on one side of the other one of the supports, a fixed mold having a molten metal guide hole formed therein is fixed to the mold fixing plate, a support rod is fixed on the other side of the other one of the supports, an additional support plate is disposed at the end of the support rod, a third cylinder is fixed to the support plate, whereby a plunger of the third cylinder pushes the molten metal into the molten metal injection pipe and the metal is cast within the casting space formed by the fixed mold and the movable mold according to the shape of the casting space, the die casting machine comprising:

a vacuum tank in which a vacuum apparatus is connected to a vacuum pump;

a material injection pipe for injecting a material into the vacuum tank;

two or more valves disposed in the material injection pipe for precluding air from introducing into the vacuum tank while the material is injected;

a fourth cylinder that makes a plunger follow it, for supplying the material into the vacuum tank via the material injection pipe;

a melted liquid crucible disposed within the vacuum tank for melting the material;

a rack and a pinion for making the melted liquid crucible inclined in order to supply a melting metal that is melted within the melted liquid crucible toward the molten metal injection pipe by rotating the melted liquid crucible;

a molten metal outflow hole formed at the bottom of the vacuum tank for introducing the molten metal discharged from the melted liquid crucible into the molten metal injection pipe; and a first plate valve disposed at a lower side of the vacuum tank for opening and shutting the molten metal outflow hole, wherein a plughole through which the plunger for pushing the material is formed in a second plate valve within one of the two or more valves that are fixed to the material injection pipe.

3. The die casting machine as claimed in claim 2, wherein the first plate valve is installed between the molten metal outflow hole of the vacuum apparatus and the entrance of the molten metal injection pipe, and wherein the melted liquid crucible supplies the molten metal to the molten metal injection pipe.

4. A method for injecting and casting a molten metal within a casting space formed by a combination of a fixed mold and a movable mold using a die casting machine, comprising: (1) a horizontal injection step wherein an upper portion of the die casting machine as claimed in claim 1 or claim 2 slopes down from the fixed mold to the movable mold, so the molten metal flows horizontally along the molten metal injection pipe and is injected into the chamber of the sleeve; and (2) a vertical injecting step, wherein the molten metal in the chamber is injected in a vertical direction into the casting space.

* * * * *